US005136811A

United States Patent [19]

Lyons, Sr.

[11] Patent Number: 5,136,811

[45] Date of Patent: Aug. 11, 1992

[54] TORQUE ROD COUNTERBALANCED DOOR ASSEMBLY

[75] Inventor: Robert J. Lyons, Sr., Hamden, Conn.

[73] Assignee: The Bilco Company, West Haven, Conn.

[21] Appl. No.: 579,924

[22] Filed: Sep. 7, 1990

[51] Int. Cl.[5] ..... E05F 1/10

[52] U.S. Cl. ..... 49/386

[58] Field of Search ..... 49/366, 367, 379, 386, 49/394

[56] References Cited

U.S. PATENT DOCUMENTS

| | | | |
|---|---|---|---|
| Re. 32,878 | 2/1989 | Leonard | 16/298 |
| 3,067,453 | 12/1962 | Lyons | 49/386 X |
| 3,438,152 | 4/1969 | Cadiou | 49/386 |
| 3,660,940 | 5/1972 | Tavano | 49/366 |
| 3,665,958 | 5/1972 | Dunkelis | 49/386 X |
| 3,729,770 | 5/1973 | Lasier | 49/379 X |
| 3,792,556 | 2/1974 | Anghinetti et al. | 49/379 X |
| 3,896,595 | 7/1975 | Anghinetti et al. | 49/386 X |
| 4,071,977 | 2/1978 | Price | 49/379 X |
| 4,084,516 | 4/1978 | Ravani et al. | 49/366 X |
| 4,534,132 | 8/1985 | Smith | 49/367 X |
| 4,589,164 | 5/1986 | Leonard | 16/299 |
| 4,621,391 | 11/1986 | Leonard | 16/299 |
| 4,670,940 | 6/1987 | Leonard | 16/308 |
| 4,681,307 | 7/1987 | Leonard | 267/154 |
| 4,873,791 | 10/1989 | Lyons | 49/386 |

FOREIGN PATENT DOCUMENTS

| | | | |
|---|---|---|---|
| 1003059 | 2/1957 | Fed. Rep. of Germany | 49/386 |
| 2238802 | 9/1971 | Fed. Rep. of Germany | 49/386 |

OTHER PUBLICATIONS

"1990 Catalog Bilco Doors for Special Services" by The Bilco Company New Haven, CT Copyright 1990.

*Primary Examiner*—Renee S. Luebke
*Assistant Examiner*—Jerry Redman
*Attorney, Agent, or Firm*—DeLio & Associates

[57] ABSTRACT

A counterbalanced door assembly particularly suited for heavy-duty load bearing applications such as sidewalk access doors, and for precasting into concrete slabs, comprises a door, a frame surrounding the door, a hinge connecting the door to the frame for rotation about a first axis, a torque rod arm mounted to rotate about a second axis displaced from the first axis, and one or more torque rods. One end of the torque rod arm is connected to the torque rod to twist the torque rod as the torque rod arm rotates about the second axis thereby generating a counterbalance force. A force control mechanism, which may be a cam with a properly shaped cam surface or a link hinged at either end, receives the counterbalance force from the torque rod arm and applies it in a controlled direction over a controlled effective moment arm relative to the first axis to generate the desired counterbalance torque.

5 Claims, 5 Drawing Sheets

TORQUE ROD COUNTERBALANCED DOOR ASSEMBLY

Background of the Invention

1. Field of the Invention

This invention relates to door assemblies in which a door is hinged to a frame along a non-vertical hinge line and torque rods are used to counterbalance the door so that it can easily be lifted against the force of gravity. The invention particularly relates to large, heavy load-bearing doors such as flush-mounted sidewalk or floor access doors where it is desirable to precast the door and frame into a concrete slab.

2. Description of Related Art

There are numerous applications in which a door is hinged along a non-vertical hinge line and must be opened and closed against the force of gravity. Such applications include sidewalk access doors, floor hatches, roof hatches, elevator and machinery access panels and the like. Such doors are often used in areas where foot traffic is expected, or where vehicle traffic may occur, and therefore must be extremely strong and are usually quite heavy.

Doors of this type can be dangerous due to their tendency to close rapidly and with great force when released, and it has been common to provide some means of counterbalancing to eliminate this danger. An additional benefit obtained by counterbalancing is that the door can be opened more easily by individuals with less risk of back strain, or can be motorized and opened with less power and with smaller motors.

In doors of this type, the counterbalancing has usually been provided by tubular compression spring operators. Where the doors are particularly heavy, multiple compression spring operators have been used.

Multiple compression spring operators have been preferred for heavy applications because of the force which can be generated and the simplicity with which they can be ganged together to provide the necessary counterbalancing. However, to achieve the necessary counterbalancing force over the required distance, compression springs must extend significantly below the level of the door and frame. A typical spring length has been twelve (12) inches (30 centimeters), while door frames are usually only 3–4 inches (8–10 centimeters) high and concrete slabs are usually only 6 inches (15 centimeters) thick.

Thus, compression springs have disadvantages in certain applications, particularly where the door is to be precast into a concrete slab, or where the space below the door will be used as a work space and the headroom is limited. In precasting operations where the standard slab is six (6) inches (15 centimeters) thick, the compression springs do not fit into the precaster's molds and holes must be cut into the mold to accommodate the length of the spring. For lighter doors, torque rods have occasionally been used in the counterbalancing mechanism. However, there is a problem in that torque rods provide a counterbalancing torque which is a linear function of their twist, while a non-vertically hinged door requires a counterbalancing torque which is a sinusoidal function of the opening angle.

Nonetheless, previous torque rod counterbalancing systems were designed to directly twist the rod by the same amount as the opening angle of the door by connecting one end of the rod to the door and one end to the frame. This was a convenient way to twist the rod and apply some counterbalancing torque, but it resulted in only partial counterbalancing. Usually the door was undercompensated at the center of its range which made the torque rod system poorly suited for counterbalancing heavy doors where the amount of uncompensated weight was high.

Bearing in mind these and other deficiencies of the prior art, it is therefore an object of the present invention to provide a counterbalanced door and frame assembly suitable for use with large, heavy non-vertically hinged doors in which the door is substantially counterbalanced by torque rods over its entire opening range.

An additional object of the invention is to provide a means of coupling multiple torque rods to increase the torque available and counterbalance heavier doors.

Another object of the invention is to provide a simple yet strong method for engaging the rods to be twisted and for shaping the rods with bent ends such that different left and right-hand versions of the rods are not required.

A further object of the invention is to provide a counterbalanced door and frame assembly wherein the frame forms a continuous wall around the door and wherein the counterbalance mechanism does not project below the level of the frame such that the assembly is suitable for precasting into a concrete slab.

Still another object of the invention is to provide a torque rod arm and cam counterbalancing mechanism wherein the cam is provided with a track for guiding and stabilizing the torque rod arm under heavy counterbalancing loads.

SUMMARY OF THE INVENTION

The invention comprises a counterbalanced door assembly including a door, a frame, a hinge connecting the door to the frame for rotation between a closed position and an open position about a first non-vertical hinge axis, a torque rod arm having a force applying end and a rotating end, the rotating end being mounted to rotate about a second axis displaced from the first axis, and a torque rod having a fixed end and a rotating end. The rotating end of the torque rod arm is mounted in operative engagement with the rotating end of the torque rod to twist the torque rod as the torque rod arm rotates about the second axis thereby generating a counterbalance force at the force applying end of the torque rod arm.

A force control mechanism, which may be a cam with a properly shaped cam surface or a link hinged at either end, receives the counterbalance force from the torque rod arm and applies it in a controlled direction over a controlled effective moment arm relative to the first axis to generate the desired counterbalance torque about the first axis.

The force control mechanism and the fixed end of the torque rod are connected between the door and the frame such that the counterbalance torque substantially counterbalances the door. The counterbalanced door assembly preferably has a height no greater than the height of the frame when the door is closed so that the entire frame may be contained in a precast mold with the frame acting as a form wall to prevent the concrete from entering the door assembly.

The ends of the torque rods are preferably shaped by bending to provide a reliable means of twisting the torque rods. The torque rods are bent in a single plane, without left and right hand versions, and may be mounted adjacent to one another to increase the counterbalancing torque.

BRIEF DESCRIPTION OF THE DRAWINGS

For a fuller understanding of the invention, reference should be made to the following description, taken in conjunction with the accompanying drawings, in which.

DETAILED DESCRIPTION OF THE INVENTION

Figure 1:
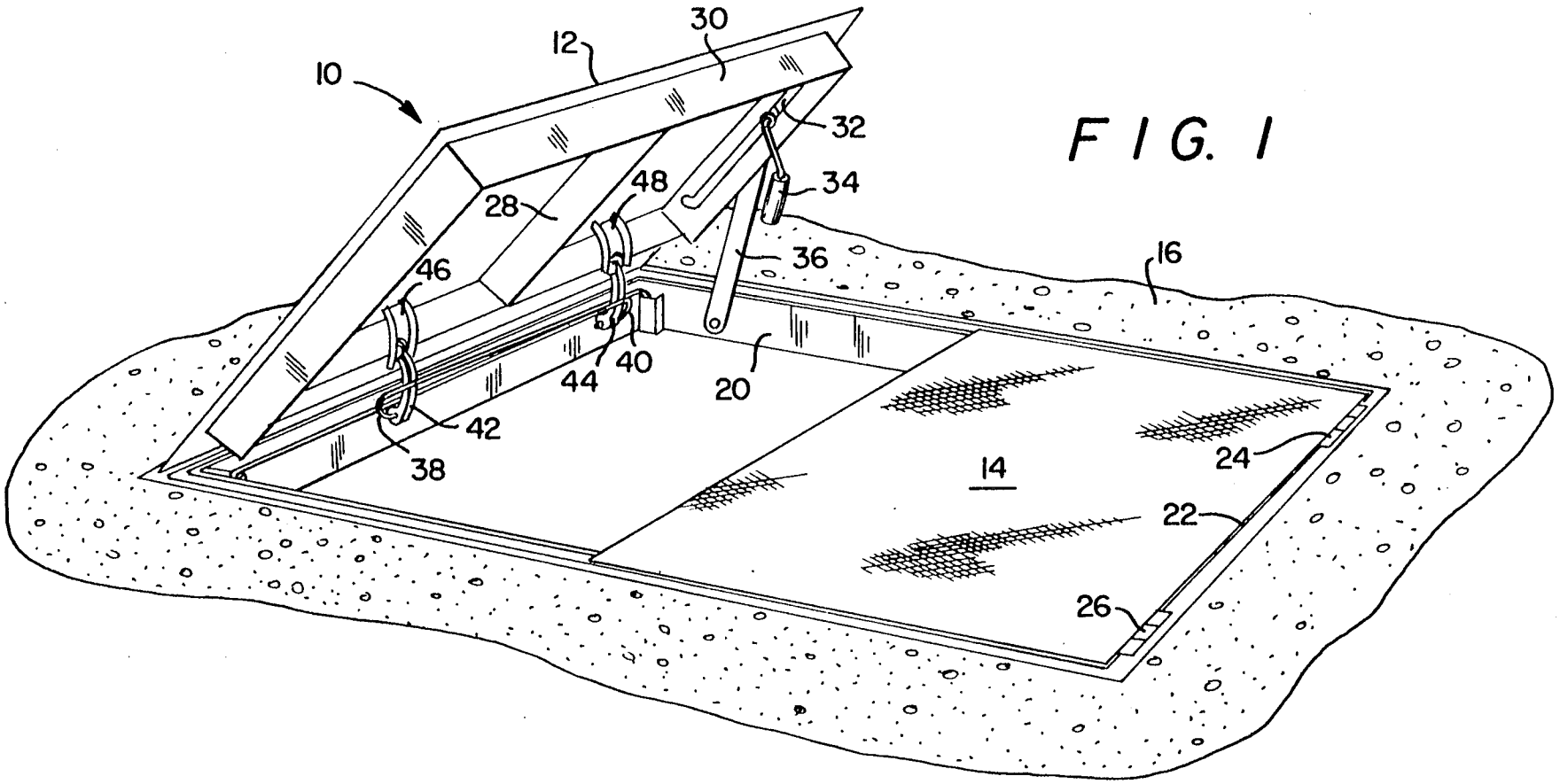
FIG. 1 is a perspective view of a double leaf, flush-mounted door and frame assembly, one leaf being open to show the cam embodiment of the counterbalance mechanism, one torque rod being used for each torque rod arm.

FIG. 1 shows a counterbalanced door and frame assembly generally indicated at 10 having two door leaves 12 and 14. The assembly is shown cast into place in a concrete floor 16 with one door leaf 12 being open to show the internal support structure and counterbalancing mechanism.

Door leaf 14 is hinged to frame 20 along a hinge axis 22 which passes through hinges 24, 26 on door leaf 14. Corresponding hinges hold door leaf 12 to the frame 20 so that door 12 can rotate about a first hinge axis as indicated.

The upper surfaces of doors 12 and 14 are strengthened with three (3) cross ribs 28 and two (2) longitudinal ribs 30. This provides the support needed for live loads on the upper surface, but adds to the weight to be balanced. An L-shaped slot 32 is formed in the end cross rib and acts with a release handle 34 and a support strut 36 to lock the door into the open position.

Figure 2:
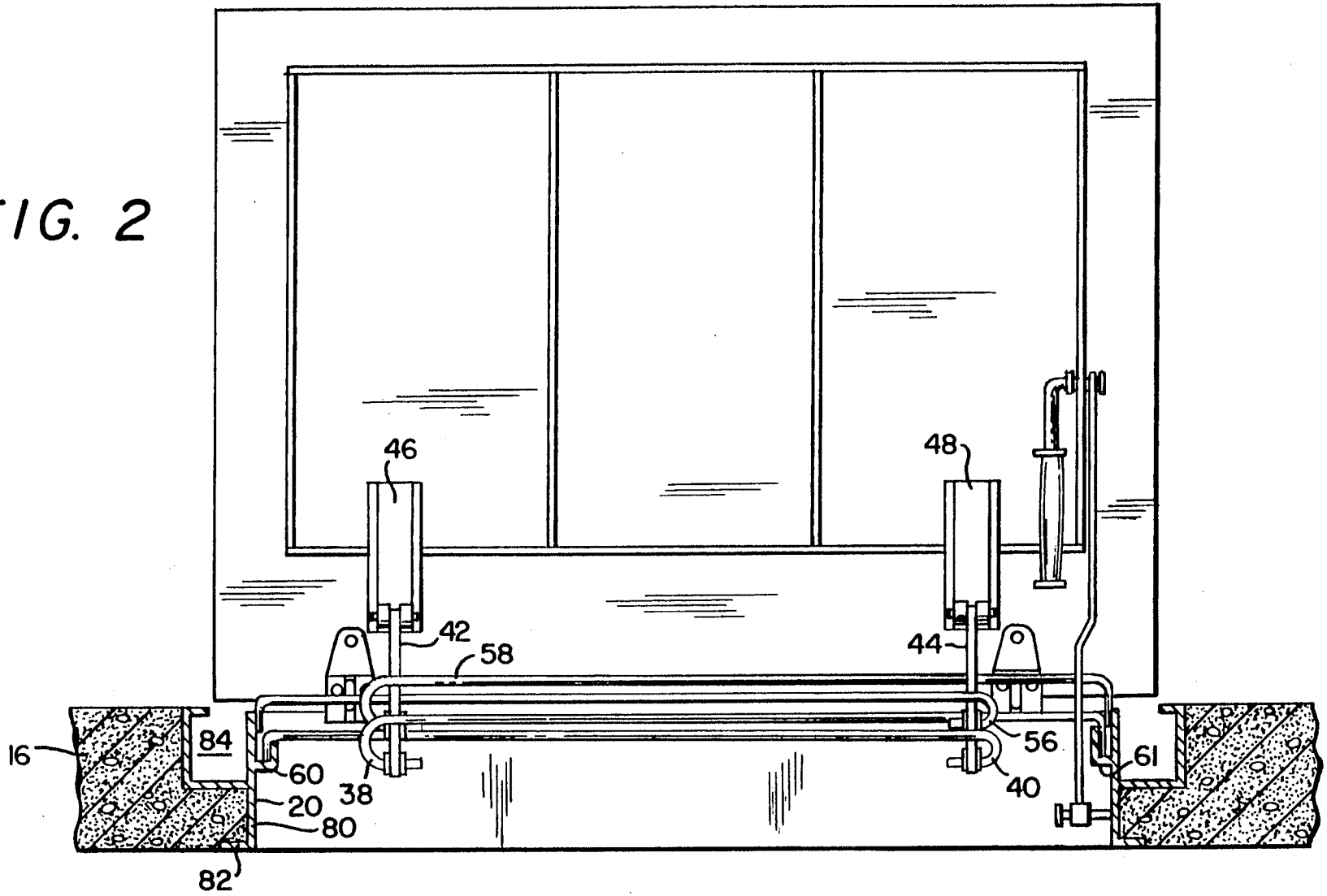
FIG. 2 is a front elevational view along a section through a precast slab showing a fully open door (larger than the door shown in FIG. 1) where each torque rod arm is driven by two torque rods.
Figure 4A:
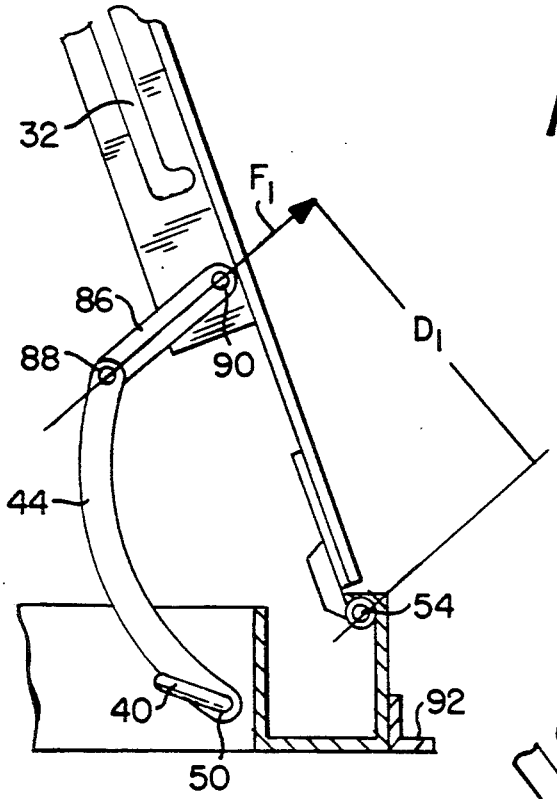
FIGS. 4*a*–4*c* are detail views from the side showing the scissors action counterbalancing embodiment of the present invention at three (3) different door angles.
Figure 4B:
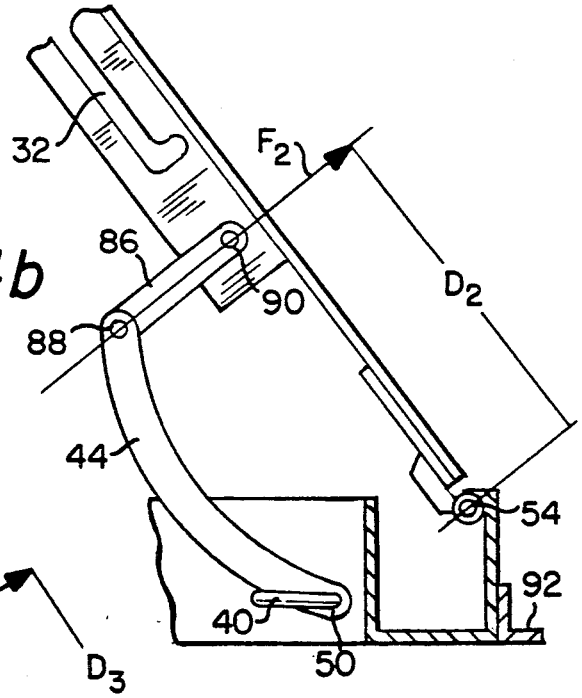
Figure 4C:
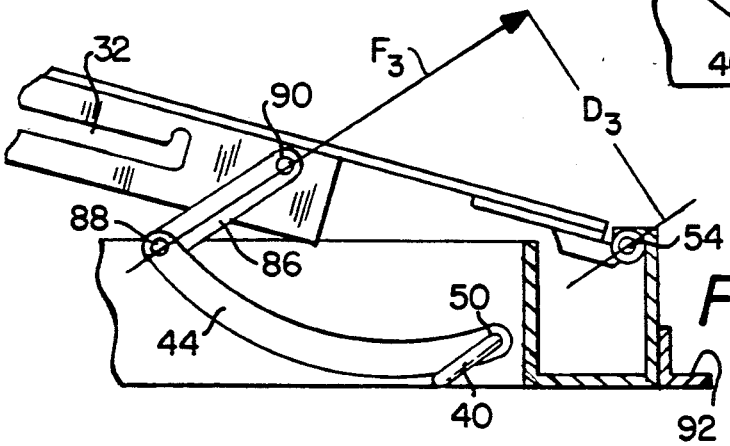

FIG. 1 shows the cam embodiment of the counterbalance mechanism of the present invention in which a single torque rod has been used for each torque rod arm. An embodiment for a heavier door with two (2) torque rods per arm is shown in FIG. 2, and an embodiment with a scissors-action link mechanism, instead of the cam, is seen in FIGS. 4*a*–4*c*.

Continuing to refer to FIG. 1, the counterbalance cam based mechanism can be seen at the base of open door 12. The mechanism includes a pair of torque rods 38 and 40, one for each of two torque rod arms 42 and 44. One end of each torque rod (the fixed end) is bent at ninety (90) degrees and is attached to the corner of the frame 20. The other end (the rotating end) is attached to its respective torque rod arm.

The torque rod arms 42, 44 are hinged at one end (the rotating end) to the frame and rotate about an axis (the second hinge axis) which is displaced a short distance from the first hinge axis about which the door 12 is hinged.

The torque rod arms 42, 44 act against a force control mechanism, which in this embodiment comprises cams 46 and 48, in such a manner that the linear torque rod force is converted to a sinusoidal counterbalance torque to balance the weight of the door against the force of gravity. The separation between the first hinge axis for rotation of the door and the second hinge axis for twisting of the torque rod arm is an important factor in this conversion as it provides a differential between the rotation angle of the door and the angle of twist of the torque rod.

Figure 3A:
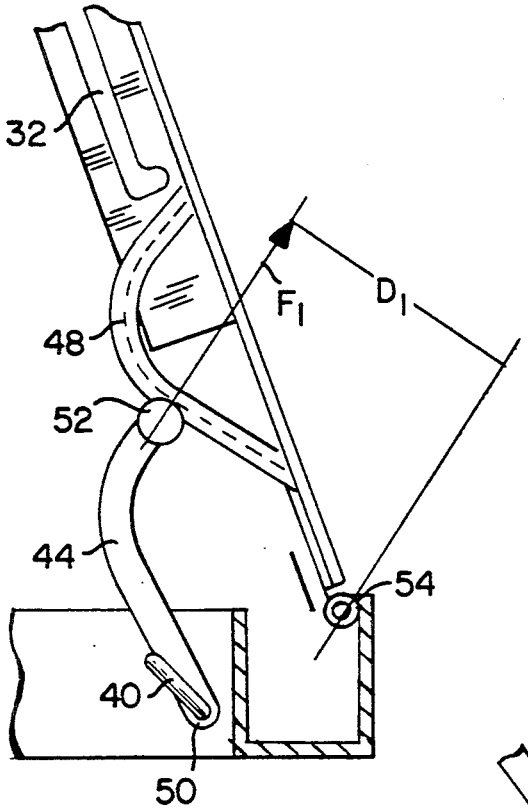
FIGS. 3*a*–3*c* are detail views from the side showing the torque rod, torque rod arm and cam counterbalancing embodiment of the present invention at three (3) different angles of the door.
Figure 3B:
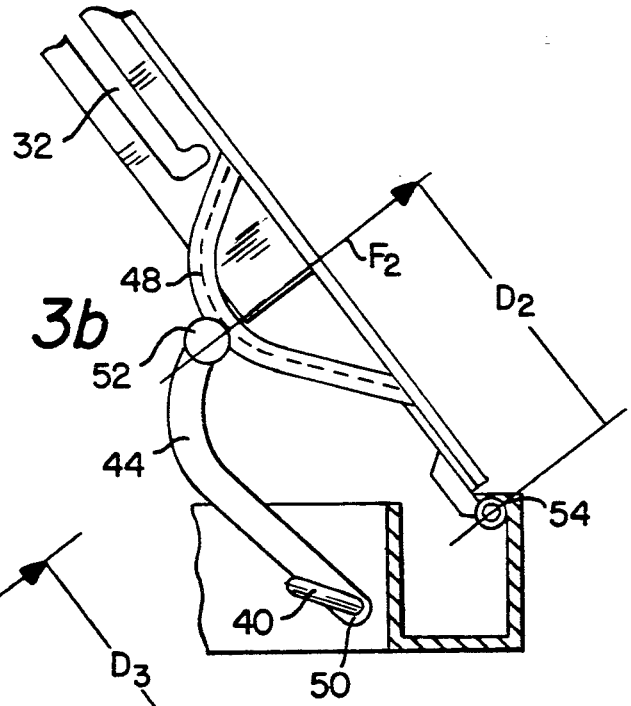
Figure 3C:
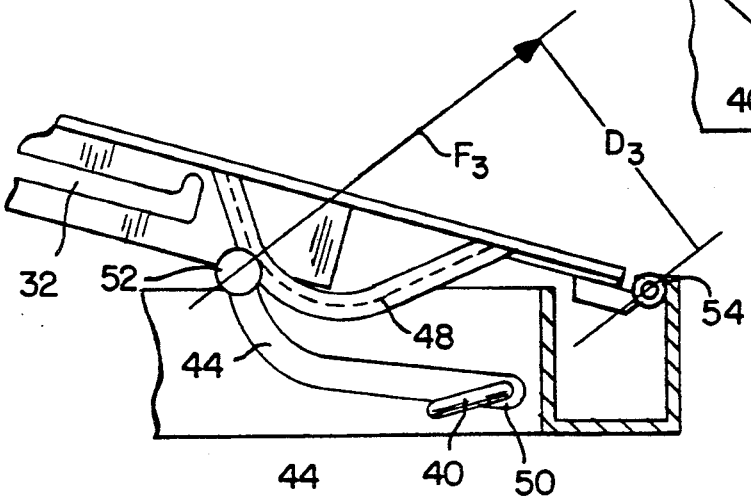

The conversion operation may be better understood by referring to FIGS. 3*a*–3*c*. which show a detail view of the torque rod arm and cam embodiment of the present invention. Although these views show a slightly different embodiment of the frame, the mechanism is identical to that shown in FIG. 1, and like numerals have been used to designate like components.

The rotating end of the torque rod 40 is bent 180° into a U-shape. The free end of the U is looped back through the rotating end of the torque rod arm to act as a pivot pin for the torque rod arm 44 along the second hinge axis 50. The other end of the U is engaged by the torque rod arm.

Thus, as the torque rod arm 44 rotates at the second hinge axis 50, it twists the rotating end of the torque rod, generating a counterbalance force which is low when the door is almost fully open as in FIG. 3*a*, and which is high when the door is nearly closed as in FIG. 3*c*. The relative magnitudes of this force, which is a direct result of the twist of the torque rod, is indicated by force vectors $F_1$ in FIG. 3*a* and $F_2$–$F_3$ in FIGS. 3*b* and 3*c*, respectively. No attempt has been made to draw these force vectors to scale, except that $F_1$ in FIG. 3*a* has been drawn smaller than $F_2$ which has been drawn smaller than $F_3$.

The counterbalancing forces $F_1$–$F_3$ are exerted by the upper end of the torque rod 44 (the force applying end) against the surface of cam 48 by means of a double wheel roller 52. The construction of the double wheel roller and the cam is seen better in FIGS. 5 and 7 and is explained more fully below.

As can be seen in FIGS. 3*a*–3*c*, and as those familiar with the operation of cams will understand, the forces $F_1$–$F_3$ are applied in a direction which is perpendicular to the surface of the cam 48. By controlling the direction of the force, one controls the effective moment arm $D_1$–$D_3$ which is measured as the distance between the direction of the force vector and the line drawn parallel to the force vector which passes through the first hinge axis 54.

Through the application of conventional engineering principles and an appropriate selection of torque rod length, torque rod diameter, shape of the cam surface and the distance between the first hinge axis 54 and the second hinge axis 50, the door can be exactly counterbalanced over its entire range.

It should be noted however, that in some applications, small departures from exact counterbalancing are desired. For example, it is often desirable to overcompensate the balance of the door at the upper end to hold the door in the fully open position. It may also be desirable to undercompensate the bottom end slightly to ensure that the door closes fully, or it may be desired to overcompensate the weight of the door when fully closed to have the door pop up out of its flush setting when unlatched, thereby providing a purchase on the edge of the door when there is no handle on the upper surface.

These and other modifications, such as providing intermediate detent stops for the door, can be provided by modifying the shape of the cam surface as desired.

FIG. 2 shows a heavier door than is seen in FIG. 1, and the door has been designed with a frame 20 particularly suited for use in a precasting operation. In this figure, like numerals have also been used to designate like components shown in FIG. 1.

The door in FIG. 2 includes four (4) cross ribs 28 to support the larger surface area of the door. To achieve a greater lifting force, each torque rod could be made shorter or thicker, as compared to the torque rods seen in FIG. 1. When the length of the rods is changed, the position of the cams is adjusted accordingly. However, FIG. 2 has been provided to show the use of multiple torque rods for each torque rod arm. Torque rod arm 44 is now driven by two (2) torque rods 40 and 56 and arm 42 is driven by torque rods 38 and 58.

Each of the torque rods 38, 40, 56 and 58 is identical in shape. The rotating end is bent 180° into a U-shape and the fixed end is bent 90°. The right angle bend of the fixed end is in the same plane as the 180° bend of the rotating end. This avoids the necessity for left and right hand torque rods. By bending the ends of the torque rods, a simple yet extremely reliable and rugged method of applying the twist to the rod is provided, suitable for the high loads and forces encountered in counterbalancing metal doors.

The first torque rods 38 and 40 are connected to the torque rod arms 42 and 44 as previously described with the rotating end of the torque rods serving as the hinge pins for the rotating ends of the torque rod arms. The second torque rods 56, 58 engage holes in the torque rod arms 44, 42 just above the second hinge axis 50 and are also twisted as the torque rod arms rotate about the second hinge axis.

Additional torque rods may be added to the two torque rods on each torque rod arm to achieve the desired counterbalancing torque.

The fixed ends of the torque rods are held in pockets 60, 61 which are secured in the corner of the frame 20. This location provides the maximum strength for resisting any twisting of the frame. The pockets, however, do not hold the fixed ends of the torque rods tightly against the frame 20. This can be seen best in FIGS. 5 and 6. Instead, the pockets have an opening which is wider than the thickness of the torque rod such that the fixed ends pivot outward slightly, angling the torque rod away from the frame 20.

This allows the right angle bend at the fixed end of the torque rod to rotate nearly into the plane of the 180° bend at the rotating end of the torque rod. The 180° bend is not parallel to the wall of the frame due to the width of the torque rod arms 42, 44.

In this manner, identical rods can be used for all four torque rods and specialized rods for left and right applications are not required. The use of the end of the torque rod as a hinge for the torque rod arms reduces the number of components and thereby reduces the cost of the door.

Figure 6:
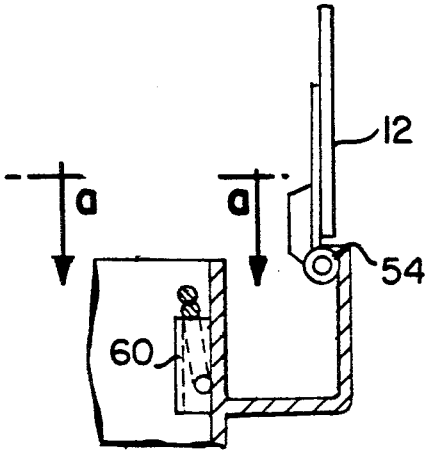
FIGS. 6 and 6*a* show the fixed ends of two torque rods and the retaining pocket in the frame in which they are held.
Figure 6A:
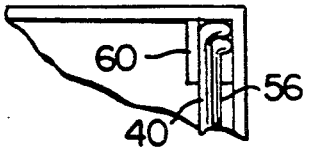

As can be seen in the detail views of FIGS. 6 and 6*a*, the pocket is small enough to hold the torque rod ar securely but large enough to permit the torque rod to angle away from the vertical. This reduces or eliminates the preloading of the torque rod due to the thickness of the torque rod arms. Some preloading is usually retained to hold the door in the fully open position, however this effect may also be achieved by adjusting the shape of the cam.

Figure 5:
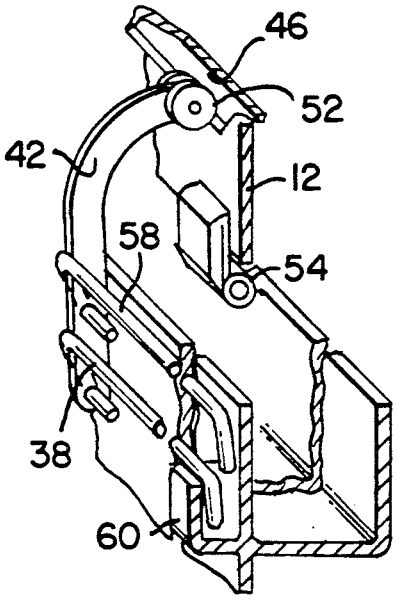
FIG. 5 is a detail view in perspective showing how two (2) torque rods are connected to a single torque rod arm, a portion of the central section of the torque rod being omitted.

FIG. 5 shows the 90° fixed end of the upper rod torque rod 58 slightly removed from the pocket 60 for clarity. In some applications, it also is desirable to place a small bolt (not shown) above the torque rods to prevent them from escaping the pocket 60, however this is generally not necessary.

Figure 7:
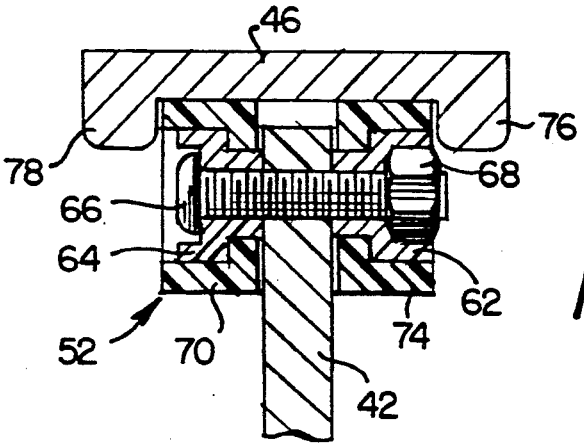
FIG. 7 is a cross-sectional view of the cam track which guides the double wheel at the end of each torque rod arm and stabilizes the arm under heavy loads.

Referring to FIG. 7, a detail view in cross section of the double wheel roller at the end of torque rod 42 can be seen. The roller comprises a pair of inserts 62, 64 which are tightly held by bolt 66 and nut 68 to the force applying end of the torque rod arm 42. The inserts 62, 64 do not rotate, but act as an axle and retainer for the wheels 70, 74. The inserts may be made of brass, stainless steel, etc., and the wheels may be made of a plastic capable of holding its shape under load. A suitable material is sold under the tradename "Delrin" sold by E. I. Du Pont de Nemours & Co.

The torque rod arm is preferably made of stainless steel and the cam 46 is preferably made of extruded aluminum with two (2) side walls 76, 78 which guide the double wheel roller (generally indicated by reference numeral 52), between them. The double wheel roller and guiding action of the track are particularly desirable for the very heavy loads encountered in counterbalancing doors of this type. The double wheels spread the load and provide a smooth action, while the track prevents the wheels from wandering as may occur under very high loads or after the bearings at either end of the arm have become worn.

Referring to FIG. 2 again, this embodiment shows the door precast into a concrete slab 16 which is typically six inches thick and which matches the height of the frame 20. The frame 20 includes a wall 80 and a right angle leg 82. The wall 80, with the other portions of the frame 20, surrounds the perimeter of the door and extends between the upper and lower surfaces of the slab 16. When the door is fully closed, the frame and door together exactly match the height of the slab to be cast and can be positioned within a precast mold without difficulty and without altering the mold in any way. Thus the frame acts as a wall of the mold, preventing the concrete from entering the open area of the door.

The angled portion 82 engages the concrete and holds the door assembly securely in the precast slab which can then be transported to the job site for installation.

The frame 20 includes a gutter 84 which passes completely around the perimeter of the door and catches any rain. The gutter 84 is connected to a drainpipe (not shown) at one corner to prevent it from overflowing or holding water for any length of time.

FIG. 4 shows an alternative embodiment for the force control mechanism which replaces the cams 46 and 48. In the embodiment shown in FIG. 4*a*, the torque rod arm 44 is connected at its rotating end to the torque rod 40 in the conventional manner. However, at the force applying end it is hingedly connected to a link 86 about a third axis 88. The link 86 is hingedly connected at a fourth axis 90 to the door 12.

As the door rotates about the first hinge axis 54 and moves from the open position of FIG. 4*a*, to the intermediate position of FIG. 4*b*, and then to the almost closed position of FIG. 4*c*, the torque rod arm rotates about the second hinge axis 50, steadily increasing the twist of the torque rod.

As was described in connection with FIG. 3*a*, the force vectors $F_1$–$F_3$ generated by the twisted torque rod are applied to the door in a controlled direction. In this embodiment, however, the direction of the force is defined by the line between the third axis 88 and the fourth axis 90, instead of by the perpendicular to the cam surface. Referring to FIG. 4*a*, the counterbalance torque applied about the first hinge axis 54 is the applied force $F_1$ times the effective moment arm $D_1$.

FIG. 4 shows a lower profile assembly than is seen in FIG.2 with an auxiliary L-shaped piece 92 used to engage the concrete when the door is cast in place.

Although the embodiments shown in the drawings illustrate the invention with the fixed end of the torque rod connected to the frame, and the force control mechanism (cam system or scissors link), attached to the door, the opposite orientation can also be used.

While the invention has been illustrated and described in what are considered to be the most practical and preferred embodiments, it will be recognized that many variations are possible and come within the scope thereof, the appended claims being entitled to a full range of equivalents.

I claim:

1. A counterbalanced door assembly comprising:

a frame;

a door;

a hinge connecting the door to the frame for rotation between a closed position and an open position about a first hinge axis lying in a non-vertical plane;

a torque rod arm having a force applying end with at least two wheels mounted thereon and a rotating end, the rotating end being mounted to rotate about a second axis displaced from the first axis;

a torque rod having a fixed end and a rotating end, the rotating end of the torque rod arm being mounted in operative engagement with the rotating end of the torque rod to twist the torque rod as the torque rod arm rotates about the second axis and generate a counterbalance force at the force applying end of the torque rod arm; and a cam having a cam surface with a track for guiding the wheels on the force applying end of the torque rod arm and receiving the counterbalance force from the torque rod arm, the cam surface being shaped to control the direction of and apply the counterbalance force over a controlled effective moment arm about the first axis and generate a desired counterbalance torque about the first axis;

the cam track including a channel with opposed upstanding walls for guiding the two wheels between the walls of the can track, the cam and the fixed end of the torque rod being connected between the door and the frame such that the generated counterbalance torque substantially counterbalances the door.

2. A counterbalanced door assembly comprising:

a door;

a frame, having an exterior and an interior, comprising a substantially continuous perimeter around the door when closed, the exterior of the frame being adapted to be set in concrete and having a thickness such that other portions of the counterbalanced door assembly do not project below a bottom portion of the frame when the door is closed;

a hinge connecting the door to the frame for rotation between a closed position and an open position about a first non-vertical hinge axis;

a torque rod arm having a force applying and with a wheel mounted thereon and a rotating end, the rotating end being mounted to rotate about a second axis displaced from the first axis;

a torque rod having a fixed end and a rotating end, the rotating end of the torque rod arm being mounted in operative engagement with the rotating end of the torque rod to twist the torque rod as the torque rod arm rotates about the second axis and generate a counterbalance force at the force applying end of the torque rod arm; and a force control mechanism for applying the counterbalance force from the torque rod arm in a controlled direction over a controlled effective moment arm relative to the first axis to generate a desired counterbalance torque about the first axis, the force control mechanism comprising a cam having a cam surface with a track comprising a channel with opposed upstanding walls for guiding the wheel on the torque rod arm;

the force applying end of the torque rod arm applying the counterbalance force to the cam surface, and the cam surface being shaped to control the direction of application of the counterbalance force relative to the first axis, the cam and the fixed end of the torque rod being connected between the door and the frame such that the generated counterbalance torque substantially counterbalances the door.

3. A counterbalanced door assembly according to claim 2 wherein the torque rod arm includes at least two (2) wheels guided between the walls of the cam track.

4. A counterbalanced door assembly according to claim 3 wherein the fixed end of the torque rod is bent and is held in a pocket, the pocket having an opening wider than the thickness of the torque rod to permit the bent portion of the fixed end to angle away from the frame.

5. A counterbalanced door assembly comprising:

a frame;

a door;

a hinge connecting the door to the frame for rotation between closed position and an open position about a first hinge axis lying in a non-vertical plane;

a torque rod arm having a force applying end and a rotating end, the rotating end being mounted to rotate about a second axis displaced from the first axis;

a torque rod having a fixed end and a rotating end, the rotating end of the torque rod arm being mounted in operative engagement with the rotating end of the torque rod to twist the torque rod as the torque rod arm rotates about the second axis and generate a counterbalance force at the force applying end of the torque rod arm; and a cam having a cam surface with a track comprising a channel with opposed upstanding walls for guiding the force applying end of the torque rod arm and receiving the counterbalance force from the torque rod arm, the cam surface being shaped to control the direction of and apply the counterbalance force over a controlled effective moment arm about the first axis and generate a desired counterbalance torque about the first axis;

the cam and the fixed end of the torque rod being connected between the door and the frame such that the generated counterbalance torque substantially counterbalances the door.

* * * * *

UNITED STATES PATENT AND TRADEMARK OFFICE

CERTIFICATE OF CORRECTION

PATENT NO. : 5,136,811

DATED : August 11, 1992

INVENTOR(S) : Robert J. Lyons, Sr.

It is certified that error appears in the above-identified patent and that said Letters Patent is hereby corrected as shown below:

In Column 6, line 4, please change "torque rod ar "
to read -- torque rod arm --.

Signed and Sealed this

Twenty-fourth Day of August, 1993

Bruce Lehman

*Attest:*

BRUCE LEHMAN

*Attesting Officer*

*Commissioner of Patents and Trademarks*